United States Patent [19]

Yamamoto et al.

[11] Patent Number: 4,765,160

[45] Date of Patent: Aug. 23, 1988

[54] WASHING MACHINE

[75] Inventors: Kenji Yamamoto; Masakatsu Morishige; Harumi Takeuchi; Yoshitaka Tsunomoto, all of Shiga, Japan

[73] Assignee: Sanyo Electric Co., Ltd., Japan

[21] Appl. No.: 873,393

[22] Filed: Jun. 12, 1986

[30] Foreign Application Priority Data

| | | | |
|---|---|---|---|
| Jun. 20, 1985 | [JP] | Japan | 60-93105[U] |
| Jun. 20, 1985 | [JP] | Japan | 60-93106[U] |
| Jun. 20, 1985 | [JP] | Japan | 60-93107[U] |
| Jul. 16, 1985 | [JP] | Japan | 60-109149[U] |
| Jul. 16, 1985 | [JP] | Japan | 61-157608 |
| Jul. 16, 1986 | [JP] | Japan | 60-157610 |

[51] Int. Cl.[4] ..... B08B 33/02

[52] U.S. Cl. ..... 68/12 R; 68/23.7; 68/133

[58] Field of Search ..... 68/12 R, 23.7, 133

[56] References Cited

FOREIGN PATENT DOCUMENTS

| | | | |
|---|---|---|---|
| 59-51881 | 3/1984 | Japan | 68/12 R |
| 61-50594 | 3/1986 | Japan | 68/12 R |

*Primary Examiner*—Harvey C. Hornsby
*Assistant Examiner*—Frankie L. Stinson
*Attorney, Agent, or Firm*—Darby & Darby

[57] ABSTRACT

A washing machine comprises a tub, in which a pulsator is rotatably arranged. The pulsator is driven by a motor positively or reversely. When a start switch is pressed, first an initial cycle is started for a relatively short period of time to dissolve detergents. When this initial cycle is completed, a main cycle is started, during which the pulsator repeats positive and reverse rotations with intervals. The main cycle is arranged to continue for a set period of time, into which auxiliary cycles shorter than the main cycle are intermittently inserted. The positively and reversely rotating times of the adjoining repeating units included in the main cycle differ with each other. In the auxiliary cycle, its repeating unit involves a relatively longer rotating time or a shorter recess time of the pulsator as compared with the repeating unit constituting the main cycle. Accordingly, during the auxiliary cycle, a water current stronger than that in the main cycle is produced, thus restraining the "entangling clothes" during a washing process.

20 Claims, 14 Drawing Sheets

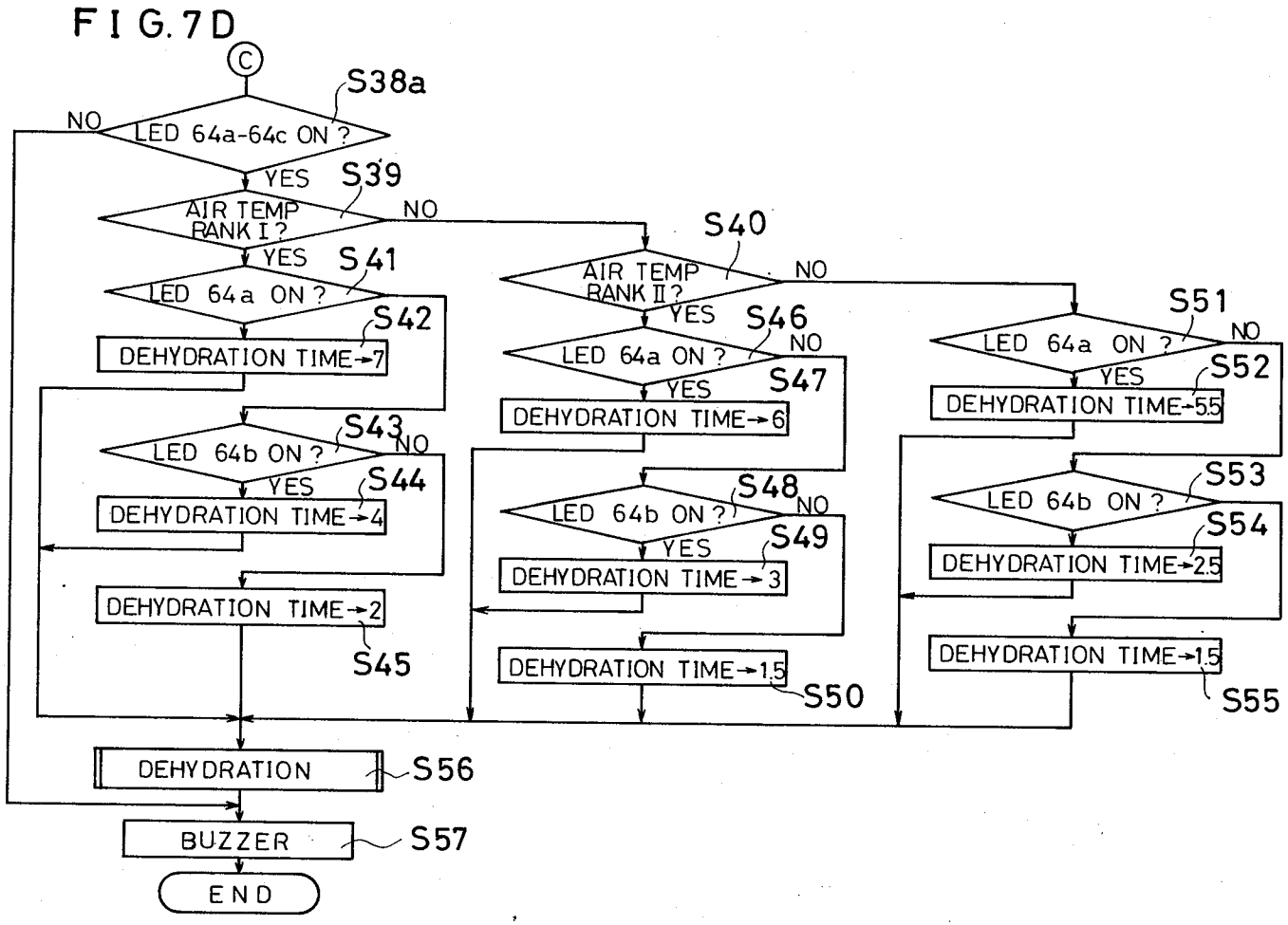
FIG. 7D
C
S38a
LED 64a-64c ON ?
NO
YES
S39
AIR TEMP RANK I ?
NO
YES
S40
AIR TEMP RANK II ?
NO
YES
S41
LED 64a ON ?
NO
YES
S42
DEHYDRATION TIME→7
S43
LED 64b ON ?
NO
YES
S44
DEHYDRATION TIME→4
S45
DEHYDRATION TIME→2
S46
LED 64a ON ?
NO
YES
S47
DEHYDRATION TIME→6
S48
LED 64b ON ?
NO
YES
S49
DEHYDRATION TIME→3
S50
DEHYDRATION TIME→1.5
S51
LED 64a ON ?
NO
YES
S52
DEHYDRATION TIME→5.5
S53
LED 64b ON ?
NO
YES
S54
DEHYDRATION TIME→2.5
S55
DEHYDRATION TIME→1.5
S56
DEHYDRATION
S57
BUZZER
END FROM STEP S127
FROM FIG.8A
S128
INITIAL CYCLE FLAG=1 ?
NO
YES
S129
INITIAL CYCLE
S130
REMAINING TIME FOR INITIAL CYCLE=0 ?
NO
YES
S131
RESET INITIAL CYCLE FLAG
TO STEP S135
S132
AUXILIARY CYCLE FLAG=1 ?
NO
YES
S138
AUXILIARY CYCLE
S139
PREDETERMINED TIME PAST ?
NO
YES
S140
RESET AUXILIARY CYCLE FLAG
S133
END CYCLE FLAG=1 ?
NO
YES
S143
END CYCLE
S134
MAIN CYCLE ACCORDING TO SET SWITCH "STRONG" "NORMAL" "WEAK"

WASHING MACHINE

BACKGROUND OF THE INVENTION

1. Field of the Invention

The present invention relates to a washing machine. More specifically, the present invention relates to a washing machine capable of adjusting a water current produced by a pulsator or an agitator of the washing machine most suitably.

2. Description of the Prior Art

In U.S. Pat. No. 4,494,390 assigned to the assignee of the present invention, an improved pulsator and a washing machine producing a water current thereby are proposed. In the prior art, since the shape of the pulsator is specially designed to generate the water current conforming thereto, wet clothes will hardly entangle with each other during a washing process, thereby damaging the clothes or still more saving such damage due to the low revolving speed of the pulsator. However, in the prior art washing machine, washing performance is not so good. More specifically, although the "entangling clothes" may be restrained because of the low rotation speed of the pulsator, the wet clothes are gradually stagnated inside a tub during a washing process, thus the washing performance will be deteriorated.

SUMMARY OF THE INVENTION

It is, therefore, a principal object of the present invention to provide a novel washing machine producing an improved water current.

It is another object of the present invention to provide a washing machine capable of restraining the entangling of clothes as well as improving the washing performance.

The present invention, in brief, is a washing machine comprising a tub, a pulsator rotatably arranged within the tub, a driving means for driving the pulsator positively and reversely, a first means for controlling the driving means to form a first cycle consisting of a set of first repeating units including the positive and reverse rotations of the pulsator and a second means for controlling the driving means to form intermittently during the first cycle, a second cycle shorter than the first cycle and consisting of a set of second repeating units including the positive and reverse rotations of the pulsator.

As the washing process is started, a main cycle or the first cycle is formed, during which the pulsator continuously repeats the first repeating unit including the positive rotation, the recess and the reverse rotation. During the first cycle, a relatively short auxiliary cycle or the second cycle is intermittently formed, which also includes the repetition of the second repeating unit consisting of the positive rotation, recess and the reverse rotation of the pulsator. By executing the second cycle, the clothes tending to stagnate inside the tub are loosen and thus the rotation thereof is accelerated. According to the present invention, therefore, the "entangling clothes" is restrained as well as the clothes are facilitated to rotate, so that the clothes are liable to move briskly and the washing performance may be improved.

In the preferred embodiment of the present invention, the second repeating unit forming the second cycle differs from the first repeating unit forming the first cycle. More specifically, the positive and reverse rotations in the second repeating unit are longer than that in the first repeating unit, or the recess time inserted therebetween is shorter than that in the first repeating unit, thus the water current produced during the second cycle is stronger than that generated during the first cycle. Therefore, the second cycle operates effectively to the restraining the "entangling clothes".

In another preferred embodiment of the present invention, the positive and reverse rotations of the respective adjoining first repeating units forming the first cycle differ with each other respectively, thereby enabling the vertical displacement of the clothes to be washed effectively within the tub. Thus, the uneven washing may be eliminated and the improved washing performance can be further obtained.

In a further preferred embodiment of the present invention, a temperature detecting means for detecting the temperature of water filled in the tub is provided. Responsive to the temperature detected by the detecting means, the number of insertion times of the second cycle being inserted intermittently during the first cycle is changed. More specifically, the lower the water temperature, the more the insertion times of the second cycle increase. Thus, according to the present invention, a sufficient washing may be attained even at the low water temperature.

In another preferred embodiment of the present invention, immediately after the start of washing process has been commanded, an initial or a third cycle is formed. The third cycle is mainly utilized for dissolving the detergents prior to the start of washing process. And preferably, the lower the water temperature, the longer duration of the third cycle is rendered.

In the other embodiment of the present invention, the tub itself is arranged rotatably and used commonly for both washing and dehydration processes, and with the temperature detecting means, the air temperature is detected and the rotating time of the tub in the dehydration process is controlled based thereupon. According to this preferred embodiment, since the dehydration time is set longer when the air temperature is lower, irrespective of the temperature, a constant dehydrated state of clothes may be obtained.

These objects and other objects, features, aspects and advantages of the present invention will become more apparent from the following detailed description of the embodiments of the present invention when taken in conjunction with accompanying drawings.

BRIEF DESCRIPTION OF THE DRAWINGS

FIGS. 7A through 7E are flow diagrams for explaining the operations of the embodiment.

DESCRIPTION OF THE PREFERRED EMBODIMENTS

Figure 1:
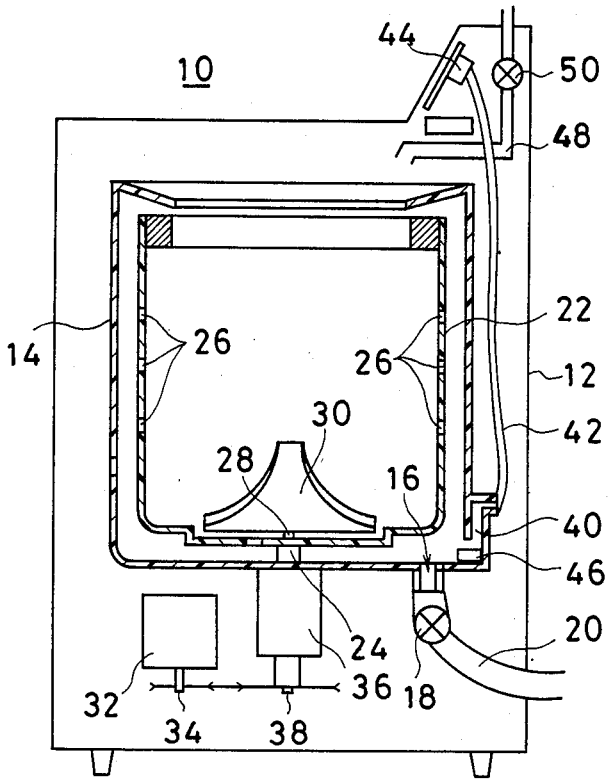
FIG. 1 is a schematic construction view showing one example of a washing machine embodying the present invention.

FIG. 1 is a cross-sectional schematic view for explaining the construction of one embodiment in accordance with the present invention. A washing machine 10 comprises a casing 12 in which an outer tub 14 is predeterminedly disposed. On the bottom of the outer tub 14, there is formed a drain outlet 16 to which a drain hose 20 is connected through a drain valve 18. The tip of the drain hose 20 is extending outwardly from the casing 12. Inside the outer tub 14, an inner tub 22 is supported rotatably with a rotary shaft 24. On the side wall and bottom of the inner tub 22, a plurality of drain holes 26 are formed. Thus, the inner tub 22 is in communication with the outer tub 14 thorugh the drain holes 26. On the bottom of the inner tub 22, a pulsator 30 is arranged and connected to a rotary shaft 28.

Inside the casing 12 under the outer tub 14, there is provided a motor 32, an output shaft 34 of which is connected to an input shaft 38 of a bearing case 36 via an attained transmission means such as a belt. The bearing case 36 is incorporated with a clutch mechanism as disclosed, for example, in U.S. Pat. No. 3,267,703 and selectively transmits the rotation given to the shaft 38 via a suitable clutch and reduction gear, to the two rotary shafts 24 and 28 heretofore described. More specifically, the clutch mechanism, not shown, connects the rotary shaft 28 to the input shaft 38 in order to rotate the pulsator 30 in the washing or rinsing process and connects the rotary shaft 24 to the input shaft 38 so as to rotate the inner tub 22 in the dehydration process.

On the lower side wall of the outer tub 14, an air trap 40 is formed in communication with a gap between the outer and inner tubs 14 and 22. The air trap 40 is connected to a semiconductor pressure sensor 44 via a hose 42. In the air trap 40, the air pressure therein is changed responsive to the water level in the gap between the outer and inner tubs 14 and 22, i.e. the water level in the inner tub 22. The change in pressure is transmitted through the hose 42 to the semiconductor pressure sensor 44, which can thus detect the variation of water level in the washing tub as the change in pressure.

Moreover, on the bottom in the air trap 40, there is provided a temperature sensor 46 having a temperature sensitive element, for example, such as a negative characteristic thermistor, which detects the water temperature while being submerged and when the washing tub is not filled with water, it is utilized for detecting the air temperature inside the casing 12.

Inside an upper portion of the casing 12, a water supply pipe 48 provided with a valve 50 is arranged and the tip of the water supply pipe 48 is positioned above the upper end opening of the washing tub or the inner tub 22.

Figure 3:
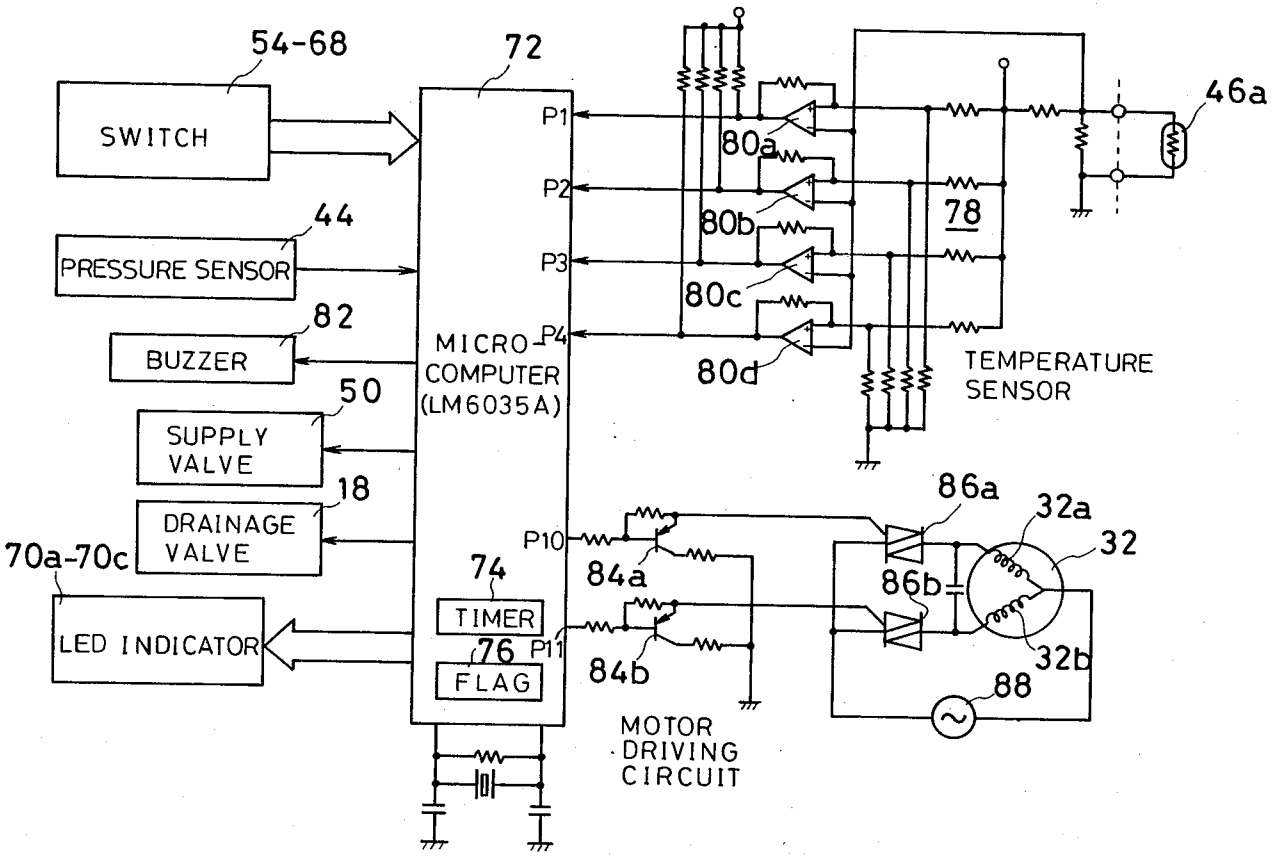
FIG. 3 is a circuit diagram showing one example of an electric circuit of the embodiment.

Inside the upper portion of the casing 12, further a control system which is to be explained later in conjunction with FIG. 3, is incorporated. In the embodiment, the control system controls all operations of the washing machine 10.

Figure 2:
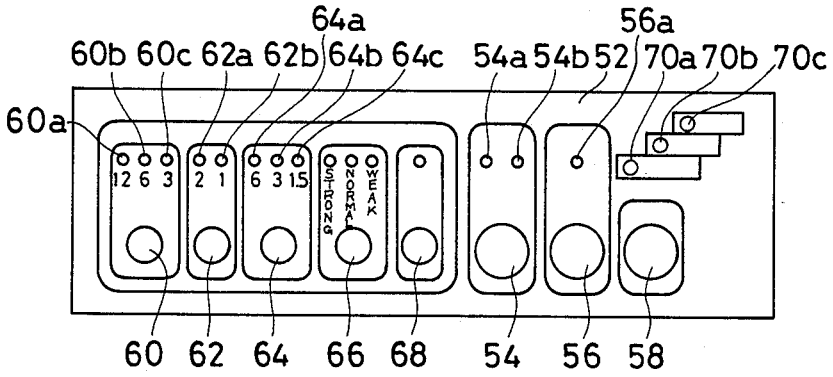
FIG. 2 is a schematic view showing one example of a control panel of a washing machine of the embodiment.

On the upper portion of the casing 12 of the washing machine 10 as is shown in FIG. 2, there is provided a control panel 52. A start switch 54 is disposed on the control panel 52. The start switch 54 is used for starting either of the "normal course" programmed in advance in a microcomputer 72 shown in FIG. 3, or the "selectable course" capable of selecting each processing time manually. While the normal course is set, a light emitting diode 54*a* is lit and while the selectable course is set a light emitting diode 54*b* is lit. Another start switch 56 disposed on the control panel 52 is utilized to set the "speedy course" where the whole process is completed within a shorter period of time, for example, in twenty-three minutes and to start such speedy course. As the speedy course is set, a light emitting diode 56*a* is lit.

A stop switch 58 is used for temporarily stopping the process which has been started by the start switch 54 or 56.

In the selectable course, for setting each process, respective switches 60, 62, 64, 66 and 68 are used. More specifically, the switch 60 is used for setting the "washing" time and by operating the switch 60, the washing times of "three minutes", "six minutes" or "twelve minutes" may be set. As the washing time is set in such a manner, corresponding diodes 60*c*, 60*b* or 60*a* is lit. The switch 62 is used for setting the number of times of rinsing and by operating the switch 62, one or two times of rinsing may be set. As the number of times of rinsing are set in such a manner, corresponding diodes 62*b* or 62*a* is lit. The switch 64 is used for setting the "dehydration" time and by operating the switch 64, the dehydration time of "one and half", "three" or "six" minutes may be set. As the dehydration time is set in such a manner, corresponding diodes 64*c*, 64*b* or 64*a* is lit.

The switch 66 is used for setting the magnitude of water current produced by the pulsator 30 (FIG. 1), and by operating the switch 66 the magnitude of water current of "strong", "normal" and "weak" may be set. As it will be explained later in detail in conjunction with FIGS. 6A through 6C, at the strong water current, the recess time inserted between the positive and reverse rotations of the pulsator is relatively shorter, for example, such as "0.2 seconds", while at the normal water current such recess time is set, for example, at "0.5 seconds", and at the weak water current the recess time is further set at "1.0 seconds".

Figure 11:
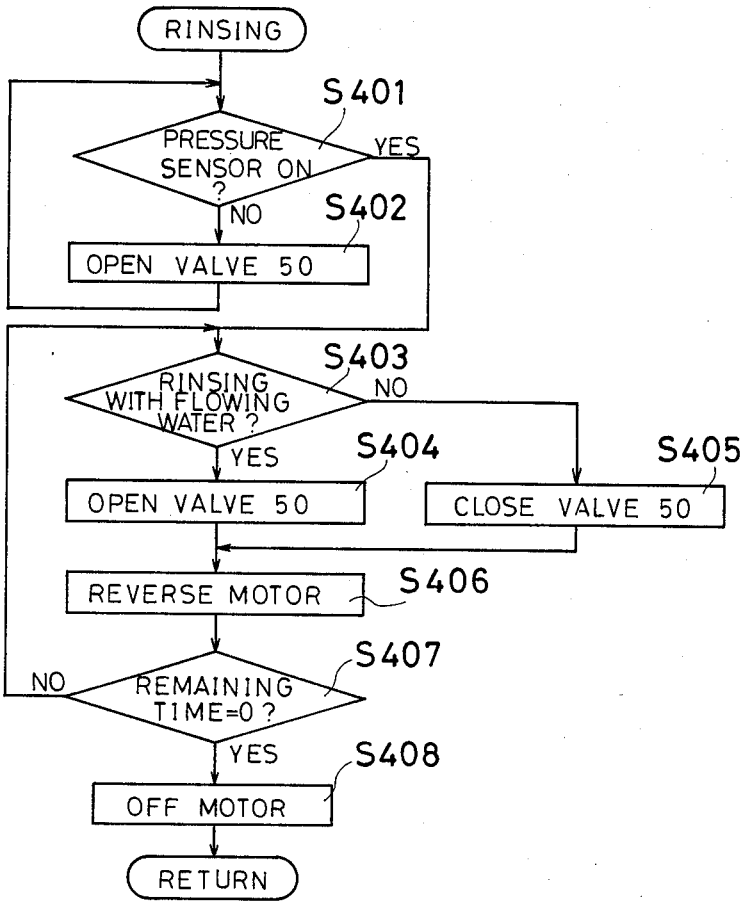
FIG. 11 is a flow diagram showing a subroutine of the "rinsing".

The switch 68 is used for setting the "rinsing with flowing water" where the rinsing is performed as the water is supplied from the water supply pipe 48 (FIG. 11).

On the control panel 52, three light emitting diodes 70*a*, 70*b* and 70*c* for indicating the temperature are disposed. These diodes 70*a* through 70*c* are commonly used to indicate the water temperature inside the inner tub 22 or the air temperature inside the casing 12. The diodes 70*a* through 70*c* indicate the water or air temperature in ranks, that is, the diode 70*a* indicates the high temperature, the diodes 70*b* indicates the medium and the diode 70*c* indicates the low temperature.

FIG. 3 is a circuit diagram showing one example of a control system of the embodiment. The control system includes a microcomputer 72, for example, such as an integrated circuit "LM6035A" by Tokyo Sanyo. The microcomputer 72, although not shown includes a ROM for storing in advance a control program as is shown in the flow diagram to be described later and a RAM for storing a necessary data upon controlling. In the RAM, a timer 74 controlling the positively rotating time, the recess time, the reversely rotating time and other time controls as well as a flag area 76 are incorporated.

To an input port of the microcomputer 72, the switches 54 through 68 incorporated in the control panel 52 shown in FIG. 2 are connected, thus through these switches 54 through 68, the controlling conditions may be inputted to the microcomputer 72. The pressure sensor 44 shown in FIG. 1 is also connected to an input port of the microcomputer 72..

To the other input port of the microcomputer 72, the signal from the temperature sensor 46 (FIG. 1) is applied. More specifically, the temperature sensor 46 includes a temperature sensitive element **46*a*, for example, such as a negative characteristic thermistor. A resistance value of the temperature sensitive element 46*a* will change responsive to the water temperature in the tub 22 or the air temperature inside the casing 12. The voltage determined by the resistance value of the temperature detecting element 46*a* and the reference voltage determined by a resistance net-work 78 are compared by respective comparators 80*a* through 80*d*, whose outputs are inputted to the microcomputer 72. In other words, from the temperature sensor 46, four-bit data are inputted to the input ports P1 through P4 of the microcomputer 72** responsive to the water temperature or the air temperature.

The microcomputer 72, on the basis of the 4-bit data fed from the input ports P1 through P4, determines the rank of water temperature or air temperature in accordance with the following Table 1;

TABLE 1

| Rank | Temperature Range | P1 | P2 | P3 | P4 |
|---|---|---|---|---|---|
| X | below −5° C. | L | L | L | L |
| A | above −5° C. and below 12° C. | H | L | L | L |
| B | above 12° C. and below 24° C. | H | H | L | L |
| C | above 24° C. and below 40° C. | H | H | H | L |
| D | above 40° C. | H | H | H | H |

The water temperature or the air temperature determined in such a manner are respectively indicated in ranks by means of the light emitting diodes **70*a* through 70*b* provided on the control panel 52 as previously described. For example, if the determined temperature ranks is "X" or "A", the light emitting diodes 70*c* indicating the "low temperature", if the rank is "B", the light emitting diodes 70*b* indicating the "medium temperature" and if the rank is "C" or "D", the light emitting diode 70*a*** indicating the "high temperature" are lit respectively.

To a suitable output port of the microcomputer 72, there is connected a buzzer 82, which informs an operator or an user of the completion of a series of processes and so on. The microcomputer 72 also controls the drainage valve 18 and the water supply valve 50.

To the two output ports P10 and P11 of the microcomputer 72, there are connected respective bases of switching transistors **84*a* and 84*b* for driving the motor. The respective collectors of such switching transistors 84*a* and 84*b* are commonly earthed and the respective emitters are connected to the respective gates of bidirectional thyristors 86*a* and 86*b*. The bidirectional thyristors 86*a* and 86*b* are connected to an armature coil of the motor 32 (FIG. 1) for rotating the pulsator 30 in the washing and rinsing process and in the dehydration process, for rotating the inner tub 22 together with the pulsator 30. Thus the motor 32 is rotated positively or reversely or stopped by controlling the supply route and supply time of an AC power source 88 by means of the bidirectional thyristors 86*a* and 86*b***.

More specifically, as the low level is outputted from the output port 10 and the high level from the output port P11 of the microcomputer 72, the switching transistor **84*a* is turned on and the switching transistor 84*b* is turned off off. Accordingly, the bidirectional thyristor 86*a* is turned on and the power from the AC power source 88 is applied to one armature coil 32*a* of the motor 32, thus in this state, the motor 32** is rotated positively.

When the motor 32 rotating positively in such a manner has to be stopped, the high level may be outputted at the output port P10 of the microcomputer 72. Then the switching transistor **84*a* is turned off as same as the switching transistor 84*b*, thus the bidirectional thyristor 86*a* is also turned off, so that the power from the AC power source 88 is applied neither to the armature coil 32*a* nor 32*b* of the motor 32**.

When reversing the motor 32 which is in the quiescent condition different from the positive rotation, the high level and the low level may be outputted respectively at the output ports P10 and P11 of the microcomputer 72. Then, the switching transistor **84*a* is turned off and the switching transistor 84*b* is turned on, thus the bidirectional thyristor 86*a* is turned off and the bidirectional thyristor 86*b* is turned on. Accordingly, the power from the AC power source 88 is applied to the other armature coil 32*b* of the motor 32** to rotate it reversely.

In such a manner, the microcomputer 72 will control the output (high level or low level) to its output ports P10 and P11 to rotate the motor 32 positively or reversely or the stop it.

Figure 4:
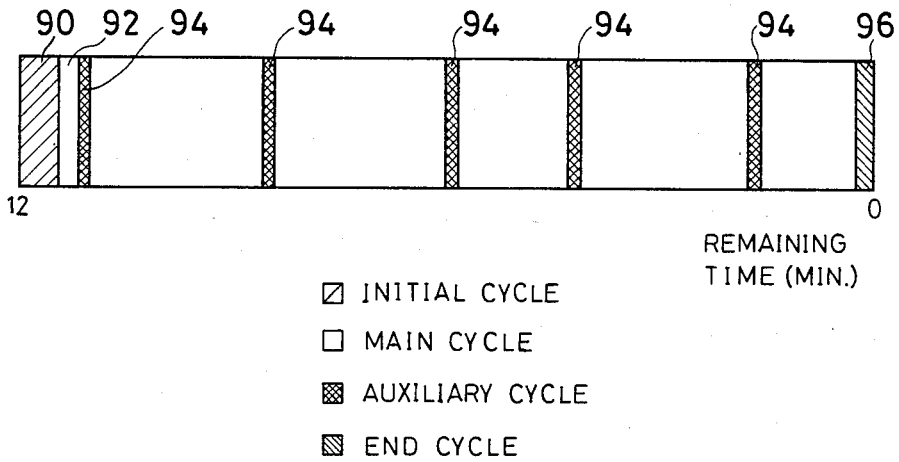
FIG. 4 is a timing diagram for explaining the operation of the embodiment and showing each cycle formed during the washing process.

FIG. 4 is a timing diagram for explaining the washing process in the embodiment. FIG. 4 shows one example, in which an user has operated the switch 60 (FIG. 2) on the control panel 52 to set the "washing" time of "twelve minutes". Before explaining the operation in detail, the washing process will be described briefly with reference to FIG. 4.

As the washing process is started, first an initial cycle 90 is executed for a relatively shorter time, for example, for thirty to fifty seconds. The initial cycle 90 is devised mainly to dissolve detergents supplied to the inner tub 22 (FIG. 1).

Figure 5A:
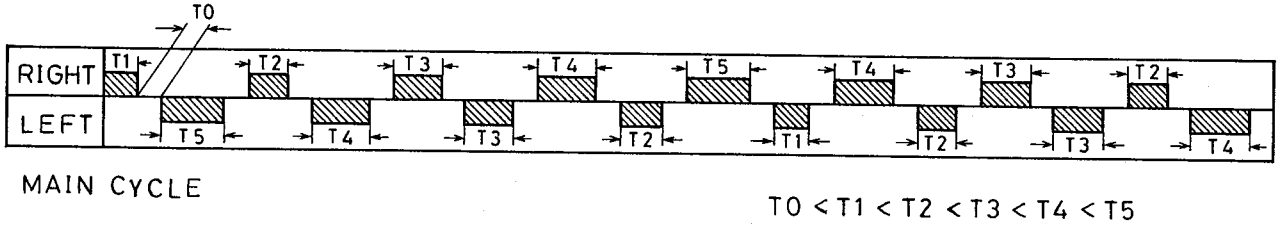
FIG. 5A is a timing diagram for explaining a main or a first cycle.

Then, succeeding to the completion of the initial cycle 90, a main cycle or a first cycle is stated. In the main cycle 92, for example, as is shown in FIG. 5A, the pulsator 30 repeats the positive and reverse rotations with recess times inserted therebetween. That is, one repeating unit is constituted by the positive rotation, the recess and the reverse rotation of the pulsator 30. The positively rotating time in every repeating units in the main cycle 92 is changed successively as T1, T2, T3,—and the reversely rotating time responsive thereto is also changed successively as T5, T4, T3,—.

Figure 6A:
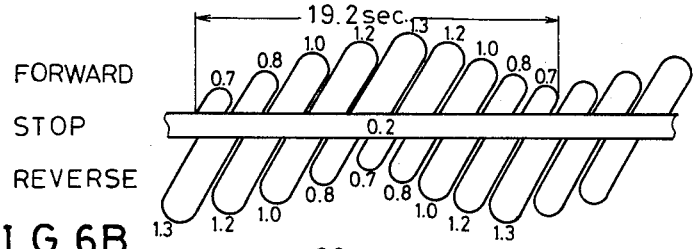
FIGS. 6A through 6C are timing diagrams for explaining the strong, normal and weak water currents in the main cycle.
Figure 6B:
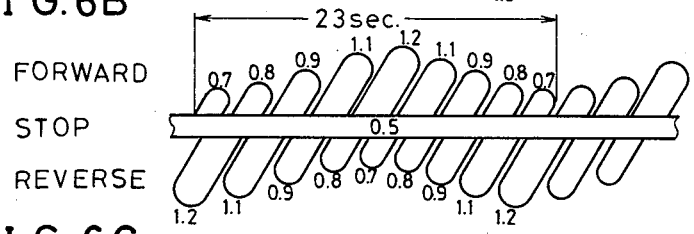
Figure 6C:
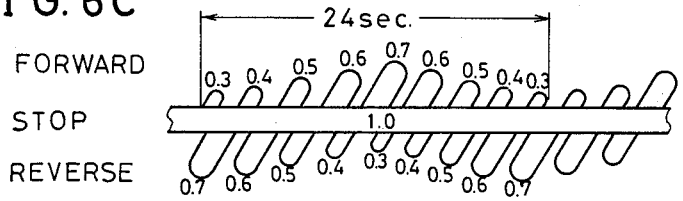

These are shown in FIGS. 6A through 6C, wherein FIG. 6A shows when "strong" is set by the switch 66 on the control panel 52, FIG. 6B shows when "normal" is set and FIG. 6C shows when "weak" is set.

In the embodiment, the repeating units of the pulsator 30 are repeatedly executed to form the main cycle 92, in which, in case of the strong water current, one period of main cycle is executed, for example, in 19.2 seconds consisting successively of the different positively rotating times and reversely rotating times with the constant recess times inserted therebetween in the following manner, 0.7 secs. positive rotation→0.2 secs. recess→1.3 secs. reverse rotation→0.2 secs. recess→0.8 secs. positive rotation→0.2 secs. recess→1.2 secs. reverse rotation → . . . → 0.8 secs. positive rotation→0.2 secs. recess→1.2 secs. reverse rotation→0.2 secs. recess→0.7 secs. positive rotation.

In case of the normal water current shown in FIG. 6B, one period is executed in 23 seconds, during which the pulsator 30 repeats the positive and reverse rotation with the constant recess times inserted therebetween to form the main cycle 92 in the following manner, 0.7 secs. positive rotation→0.5 secs. recess→1.2 secs reverse rotation→0.5 secs. recess→0.8 secs. positive rotation→0.5 secs. recess→1.1 secs. reverse rotation→0.5 secs. recess→0.9 secs. positive rotation→ . . . →0.8 secs. positive rotation→0.5 secs. recess→1.1 secs. reverse rotation→0.5 secs. recess→0.7 secs. positive rotation. The positive and reversely rotating times of the respective adjoining repeating units are controlled to differ with each other likewise the strong water current as shown in FIG. 6A.

In the weak water current shown in FIG. 6C, one period is executed, for example, in 24 seconds, during which the pulsator 30 is controlled to form the main cycle 92 in the following manner, 0.3 secs. positive rotation→1 sec. recess→0.7 secs. reverse rotation→1 sec. recess→0.4 secs. positive rotation→1 sec. recess→0.6 secs. reverse rotation→1 sec. recess→0.5 secs. positive rotation → . . . →0.4 secs. positive rotation→1 sec. recess→0.6 secs. reverse rotation→1 sec. recess→0.3 secs. positive rotation.

The strong water current is used, for example, when washing the thick clothes, the weak water current is used for the thin clothes and the normal water current is used when washing the ordinary clothes other than mentioned above.

While the main cycle 92 is being performed as such, the clothes in the inner tub 22 (FIG. 1) tend to stagnate, so that an auxiliary cycle 94 or a second cycle of a relatively shorter time period may be intermittently inserted to produce the stronger water current than the main cycle, thereby suitably loosening the stagnant clothes.

Figure 5B:
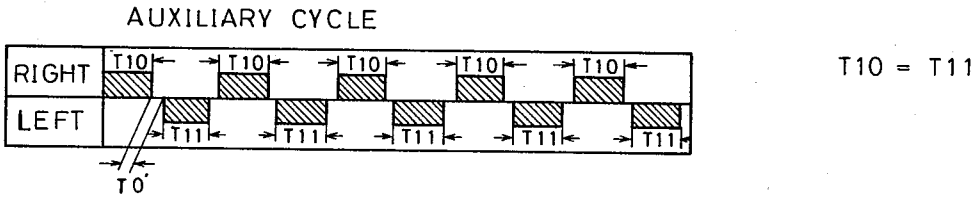
FIG. 5B is a timing diagram for explaining an auxiliary or a second cycle.
Figure 7A:
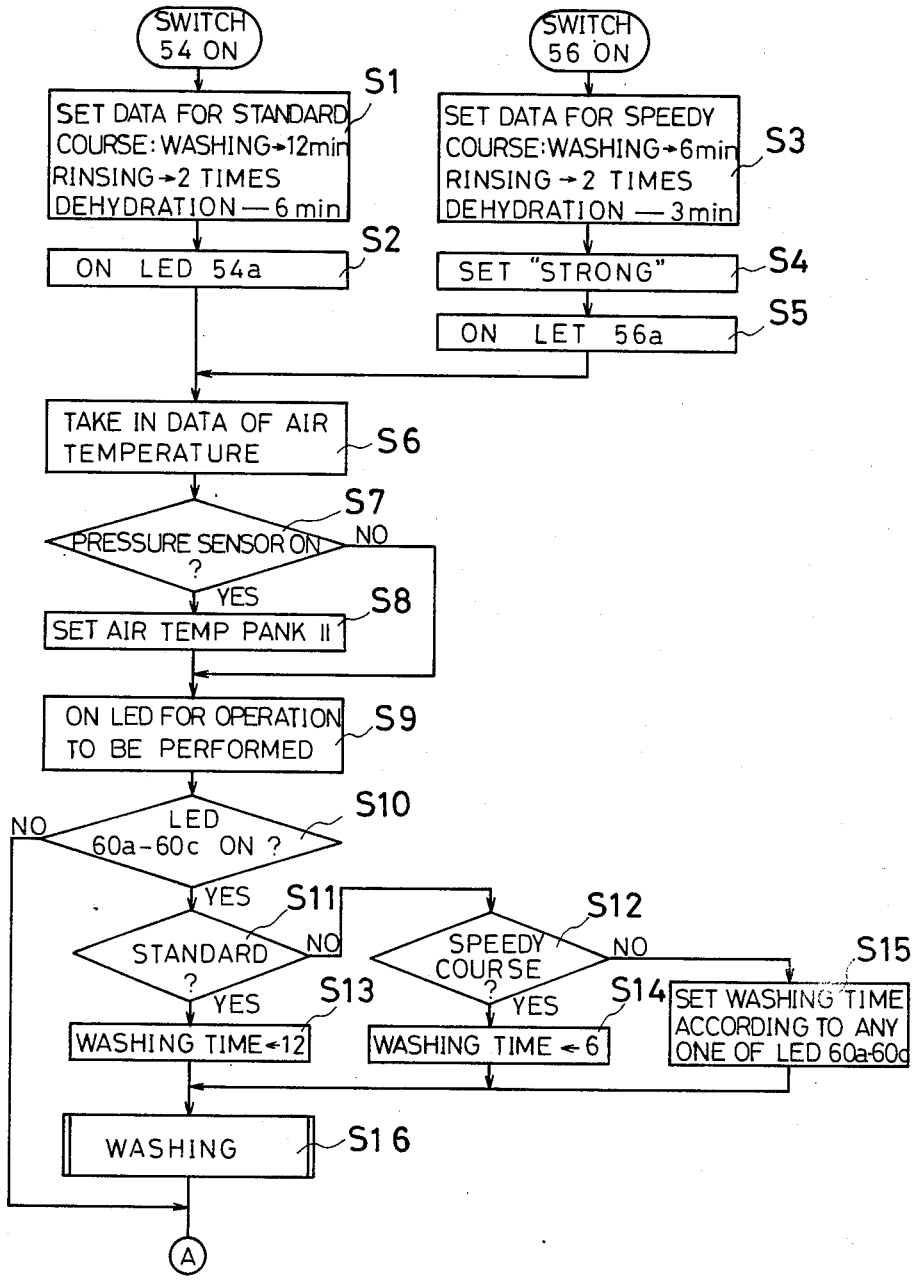
Figure 7B:
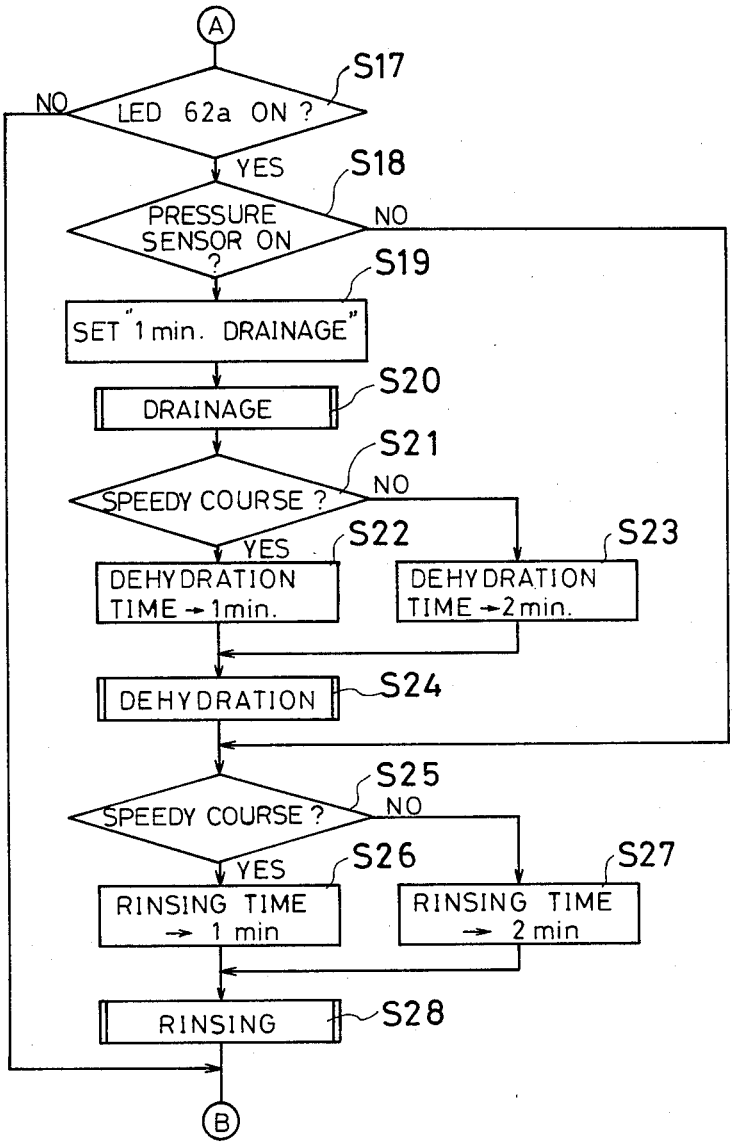
Figure 7C:
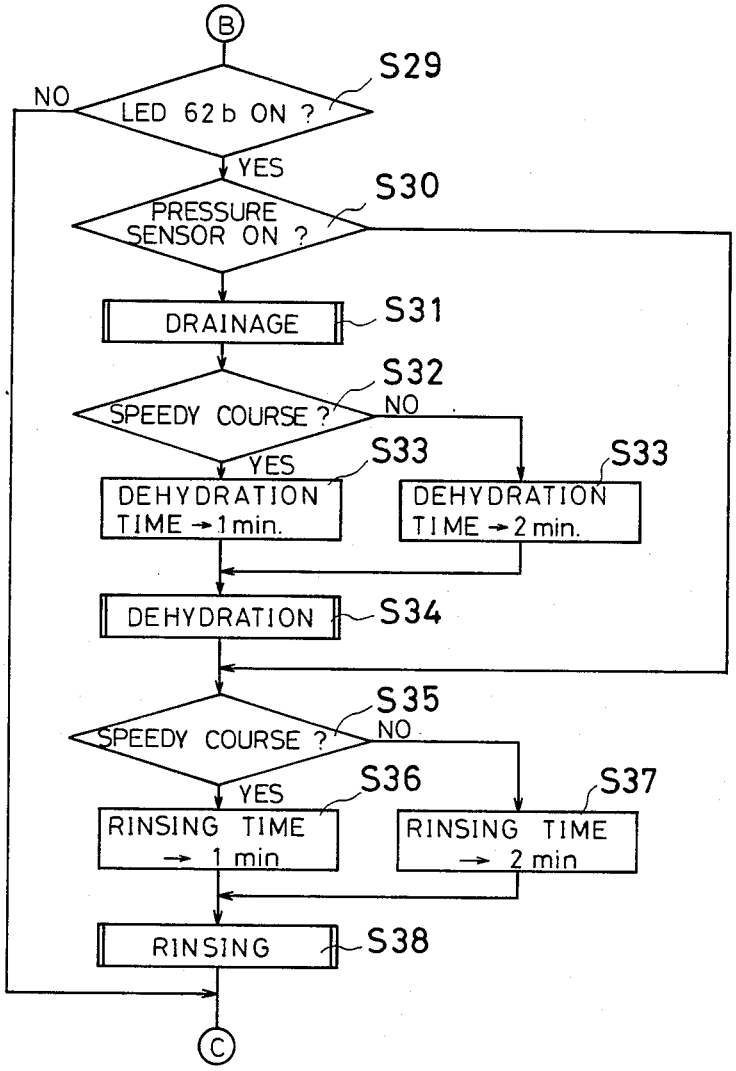

In the auxiliary cycle 94 inserted in such a manner, as is shown in FIG. 5B, the positively and reversely rotating times of the pulsator 30 are same (T10=T11), and the positive and reverse rotations are repeated with the recess time T0 (=0.1 sec.) being inserted therebetween, which is shorter than that T0 of the main cycle. That is, in the auxiliary cycle 94, a second repeating unit, for example, such as 1.0 sec. positive rotation→0.1 sec. recess→1.0 sec. reverse rotation→0.1 sec. recess is repeated. When the suitable number of times of auxiliary cycles 94 are inserted during the main cycle 92 and the remaining time is left, for example, as less than 20 seconds, an end cycle is started.

The end cycle includes a set of very short repeating units consisting of the positively and reversely rotating times of about 0.2 to 0.4 seconds and the recess time of 0.2 seconds and executed for about 10 seconds. By executing the end cycle, the tub 22 is rocked in whole and the clothes contained therein are evenly distributed in the tub and the maldistribution of load may be reduced in the following dehydration process.

Referring to FIGS. 7A through 7D, the operations of all the embodiment will be described.

As the start switch 54 incorporated in the control panel 52 (FIG. 2) is operated, in the first step S1, data for the "normal course" is loaded from the ROM (not shown ) to the RAM or register of the microcomputer 72. That is, in the normal course, the washing time of "twelve minutes", the number of rinsing times of "two times" and the dehydration time of "six minutes" are set respectively. Thereafter, in the step S2, the light emitting diode **54*a*** for indicating the execution of the normal course is lit.

When another start switch 56 is pressed, in the first step S3, data for executing the "speedy course" is loaded. That is, in the speedy course, the washing time of "six minutes", the rinsing times of "one time" and the dehydration time of "three minutes" are set respectively. In the following step S4, for the speedy course, the microcomputer 72 sets the magnitude of water current during the washing process at the "strong current" (FIG. 6A), and in the step S5, the light emitting diode **56*a*** for indicating the execution of the speedy course is lit.

After the preceding step S2 or S5, in the step S6, the microcomputer 72 inputs temperature data from the temperature sensor 46 through its input ports P1 through P4. At this time, since the water is still not supplied in the tub 22, its temperature data is for the air temperature. In the following step S7, on the basis of the input from the pressure sensor 44, whether a predetermined amount of water has been filled in the inner tub 22 is determined. If "YES" is detected in the step S7, in the step S8, the microcomputer 72 sets the air temperature rank, for example, of "medium temperature" on the basis of the air temperature data inputted in the preceding step S6. At the same time, in the step S9, the corresponding light emitting diodes are lit to indicate the time periods and times of the washing, rinsing and dehydration executed thereupon, as well as the magnitude of water current.

In the next step S10, the microcomputer 72 determines whether either of the light emitting diodes **60*a* through 60*c* associated with the switch 60 is lit or not. If either of the light emitting diodes 60*a* through 60*c* is lit, in the following step S11 or S12, the microcomputer 72** determines which course has been set, the normal course or the speedy course.

When the normal course is set, in the step S13, the microcomputer 72 sets "twelve minutes" in the timer 74 as the washing time. In the same manner, when the speedy course is set, in the step S14, the microcomputer 72 sets "six minutes" in the timer 74 as the washing time.

When neither of the normal course nor the speedy course is set, it is deemed that the selectable course is set, so in the step S15, the microcomputer 72 sets either of the washing times, "three minutes", "six minutes" or "twelve minutes" set manually by the switch 60 in the timer 74. After the washing time has been set as such, the microcomputer 72 proceeds to the "washing" subroutine.

Figure 8A:
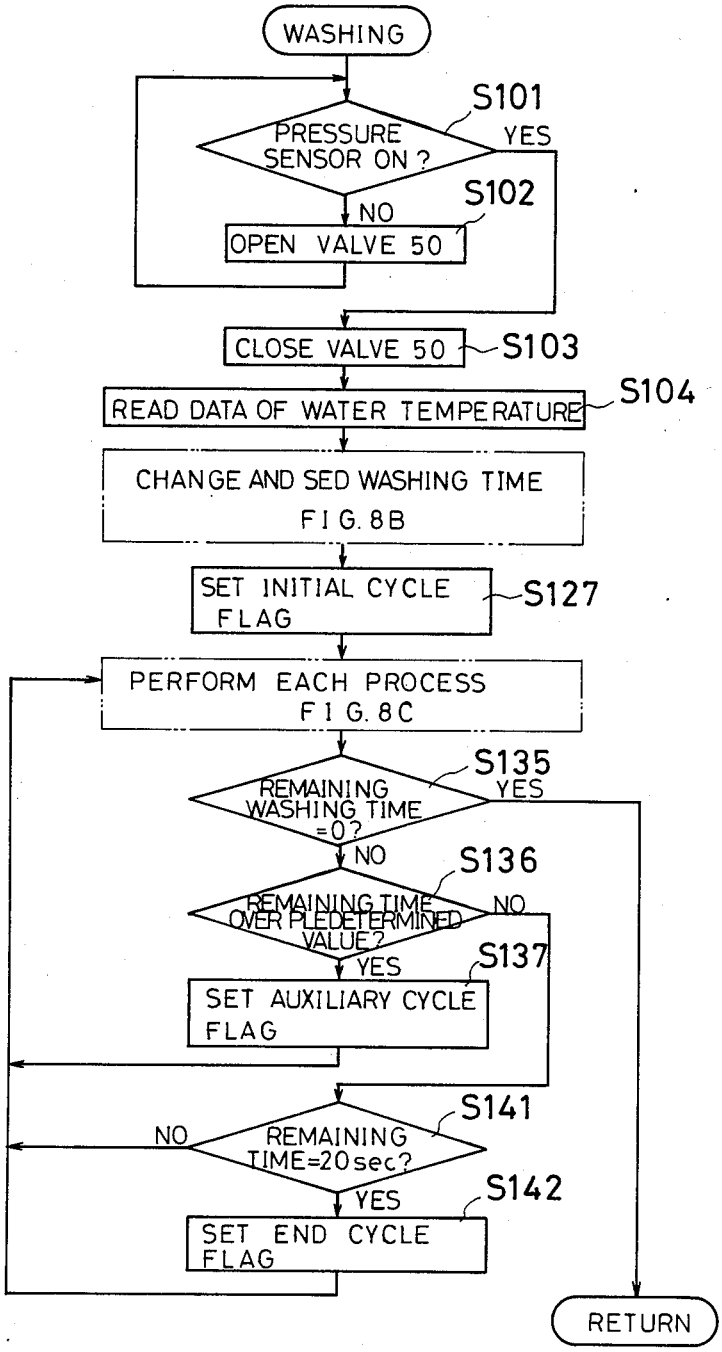
FIGS. 8A thorugh 8C are flow diagrams showing subroutines of the "washing".

Referring to FIG. 8A, in the first step S101 of the "washing" subroutine, the microcomputer 72 determines whether the water filled in the tub 22 has reached the predetermined amount responsive to the input from the pressure sensor 44. If the water is below that level, the microcomputer 72 opens the water supply valve 50 to continue the supplying of water (step S102).

When the water is filled in the tub 22 to the predetermined level, in the step S103, the microcomputer 72 closes the supply valve 50 as well as in the step S104, measures the filled water temperature on the basis of the temperature data from the temperature sensor 46 given to its input ports P1 through P4. That is, when the water is filled in the tub 22, the temperature data inputted then is for the water, thus the microcomputer 72 may be detect the water temperature.

In the step S105, the microcomputer 72 determines the rank of the water temperature based upon the temperature data received in the step S104. That is, in the step S105, it is determined whether the rank of the water temperature is "X" shown in the preceding Table 1 and when the rank of the water temperature is below "X", in the following step S106 the microcomputer operates the buzzer 82 to notice an user too low water temperature.

If the rank of the water temperature is above "X", in the following steps S107 and S108, the microcomputer 72 determines whether the water temperature is in either of the temperature ranges I, II or III. That is, in the previous Table I, if the rank is "X" or "A" the temperature range I indicating the low temperature, if the rank is "B" the temperature range II indicating the medium temperature, and if the rank is "C" or "D" the temperature range III indicating the high temperature is detected respectively.

In the step S107, if the water temperature range I is detected, in the next stop S109 the microcomputer 72 determines whether the light emitting diode **60*a* is lit or not, that is, "twelve minutes" is set as the washing time or not. When "twelve minutes" has been set, since the water temperature is low, in the following step S110, the microcomputer 72 forcibly sets "fourteen minutes" in the timer 74(FIG. 3) as the washing time. In the same manner, when "six minutes" has been set as the washing time, in the following steps S111 and S112, the microcomputer 72 sets "eight minutes" in the timer 74 as the washing time. If "three minutes" has been set as the washing time, in the step S113 the microcomputer 72 sets "three minutes" as is in the timer 74. In such a way, when the water temperature is low, the microcomputer 72 adjusts data of the washing time to be set in the timer 74** so as to extend the washing time set thereat.

In the step S108, when the water temperature rank II is detected, in the steps S114 through S118, the microcomputer 72 sets the washing times of "twelve minutes", "six minutes" and "three minutes" set thereat in the timer 74 as is as the washing time data.

In the step S108, when it is determined "NO", then the water temperature is high and the rank is III, thus in the following step S119, the microcomputer 72 determines whether "twelve minutes" is set as the washing time. When "twelve minutes" has been set, it is set in the timer 74 as is as the washing time. However, in the step S121, if the light emitting diode **60*b* is lit and it is determined that "six minutes" has been set as the washing time, in the next step S122, since the water temperature is high, the microcomputer 72 adjusts it to "five minutes" and set the data in the timer 74. When "three minutes" has been set as the washing time, in the step S123, the microcomputer 74 sets "three minutes" as is in the timer 74** as the washing time data.

As such, in the embodiment, the microcomputer 72 suitable changes the washing time originally set, responsive to the water temperature data or the rank provided from the temperature sensor 46. More specifically, the microcomputer 72 extends the washing time when the water temperature is low and shortens the washing time when the water temperature is high in accordance with the following Table 2. The reason why the washing time is changed in accordance with the water temperature is that in higher water temperature, the clothes to be washed is easily rotated or shaken, therefore, the washing performance is high, while in lower water temperature, it is difficult to rotate or shake the clothes, and thus the washing performance is low.

TABLE 2

| Water Temperature Rank | Originally set Washing Time (min) | | |
|---|---|---|---|
| | 12 | 6 | 3 |
| I | 14 | 8 | 3 |
| II | 12 | 6 | 3 |
| III | 12 | 5 | 3 |

After completing the steps S110, S112 or S113, in the step S124, the microcomputer 72 sets "50 seconds" in the timer 74 as the initial cycle time described with reference to preceding FIG. 4. Similarly, after completing the steps S115, S117 or S118, in the step S125, the microcomputer 72 sets the initial cycle time of "40 seconds" in the timer 74. After the steps S120, S122 or S123, in the steps S126, the microcomputer 72 sets "30 seconds" in the timer 74 as the initial cycle time.

As previously explained, the initial cycle 90 (FIG. 4) is mainly used for dissolving the detergents, which tends to dissolve slowly in the low water temperature. Accordingly, in this embodiment, the microcomputer 72 changes the duration of initial cycle 90 (FIG. 4) responsive to the water temperature rank detected and sets the ample dissolving time of the detergents corresponding to the then water temperature in accordance with the following table 3.

TABLE 3

| Water Temperature Rank | Initial Cycle time (secs) |
|---|---|
| I | 50 |
| II | 40 |
| III | 30 |

Thereafter, in the step S127, the microcomputer 72 sets an initial cycle flag in the flag area 76 (FIG. 3).

Then, in the step S128, the microcomputer 72 determines whether the initial cycle flag has been set and when it is determined "YES" in the step S128, it controls the output to the output ports P10 and P11, thereby the motor 32 is driven and the initial cycle water current is produced by the pulsator 30 (FIG. 1).

The initial cycle water current as previously described, comprising a set of repeating units of the positively and reversely rotating times of one second each and the recess time of 0.2 seconds. Therefore, in the step S129, the microcomputer 72, first, outputs the low level at the output port P10 and the high level at the output port P11 to positively rotate the motor 32, thus the pulsator 30 rotates positively and the water current rotating clockwise is produced in the tub 22. After one second, the microcomputer 72 outputs the high level both at the output ports P10 and P11 to stop the motor 32. When 0.2 seconds has elapsed as the recess time, the microcomputer 72 successively outputs the high level at the output port P10 and the low level at the output port P11, thus the motor 32 or the pulsator 30 is rotated reversely and the water current rotating counter clockwise is produced in the tub 22. The repeating units forming such intial cycle are continuously repeated until the remaining time=0 of the initial cycle is detected in the step S130.

In the step S130, when the lapse of initial cycle time of "50 seconds" is detected, in the step S131, the microcomputer 72 resets the initial cycle flag previously set in the flag area 76.

When the initial cycle is completed, now the microcomputer 72 in the steps S132 and S133, determines whether an auxiliary cycle flag as well as an end cycle flag is set or not. In the beginning of the washing process, since neither of these flags are set, in the step S134 the microcomputer 72 executes the main cycle.

In the main cycle, the water current having the magnitude previously set by the user manually or by the microcomputer 72 automatically is produced. When the strong current has been set, the main cycle comprising a set of repeating units as illustrated in preceding FIG. 6A is executed. In case of the normal current, the main cycle shown in FIG. 6B, when the water current is weak the main cycle illustrated in FIG. 6C are executed respectively. Such a repetition of positive rotation→recess→reverse rotation→recess, may be attained by controlling data at the output ports P10 and P11 of the microcomputer 72 in the low or high level for the necessary time, as same as the initial cycle explained at the preceding step S129.

Thereafter, in the step S135, the microcomputer 72 determines whether the washing time set in the timer 74 in the preceding steps S110, S112, S113, S115, S17, S118, S120, S122 or S123 has become zero or not.

If the washing time is not zero, in the following step S136, the microcomputer 72 determines whether the remaining time is more than a determined value or not. When it is determined "YES" in the step S136, in the step S137, the microcomputer 72 sets the auxiliary cycle flag in the flag area 76.

As the auxiliary cycle flag is set, in the step S132, "YES" is detected, thus in the following step S138 the microcomputer 72 executes the auxiliary cycle. The auxiliary cycle, as previously explained, comprising the repetition of repeating units of the positively and reversely rotating times of one second each and the recess time of 0.1 seconds. Also when executing the auxiliary cycle, the clockwise and counter clockwise rotations of the water current may be produced by the pulsator 30, if the microcomputer 72 controls 38 the switching states and the time periods of the low level and high level at its output ports P10 and P11.

The auxiliary cycle is executed for about 9.9 seconds as previously explained and in the step S139, the microcomputer 72 determines by the timer 74 whether the predetermined time period or 9.9 seconds has elapsed or not. Then, when the auxiliary cycle is completed, in the following step S140, the microcomputer 72 resets the auxiliary cycle flag previously set in the flag area 76.

Then, again in the steps S135 and S136, the microcomputer 72 determines whether the remaining washing time is more than 20 seconds or not and when the washing time is remained more than 20 seconds, the steps S134 and S138 are executed respectively and the main cycle 92 as is shown in FIG. 4 is formed as well as the auxiliary cycle 94 is formed suitably intermittently. That is, the auxiliary cycles 94 are inserted into the main cycle automatically by the number of times responsive to the total washing time. More specifically, the longer the washing time, the more frequently the auxiliary cycles are inserted in accordance with the following Table 4. The reason why the insertion times are changed in accordance with the water temperature is that the higher water temperature the more shaking of the clothes to be washed, i.e. the higher washing performance, while the lower water temperature, the less shaking of the clothes, i.e. the less washing performance.

TABLE 4

| Washing Time (Min.) | Number of Insertion Times of Auxiliary Cycle |
|---|---|
| 14 | 5 |
| 12 | 4 |
| 8 | 3 |
| 6 | 2 |
| 3 | 1 |

As previously explained, the washing time is suitable changed responsive to the water temperature rank thereat as such that, for example, even if "12 minutes" has been set, when the water temperature is low it is extended to "14 minutes". Thus, the number of insertion times of the auxiliary cycles may be also determined by the water temperature rank thereof. For example, even if the washing time and the number of insertion times of the auxiliary cycles have been set respectively at "6 minutes" and "2 times", when the water temperature rank is I, the washing time is changed to "8 minutes" and the number of insertion times of the auxiliary cycles is changed to "3 times", and when the water temperature rank is III, they are changed respectively to "5 minutes" and "one time".

In the step S141, when the remaining time less than 20 seconds is detected, in the following step S142, the microcomputer 72 sets the end cycle flag in the flag area 76. When the end cycle flag is set as such, "YES" is determined in the step S133, thus the microcomputer 72 in the step S143, execute the end cycle lastly in the washing time. The end cycle is, as previously explained with reference to FIG. 4, formed to totally rock the tub 22 for distributing the clothes evenly therein. Also, in the step S143, the microcomputer 72 suitable controls the high level or low level at its output ports P10 and P11 and the time period thereof.

Figure 8B:
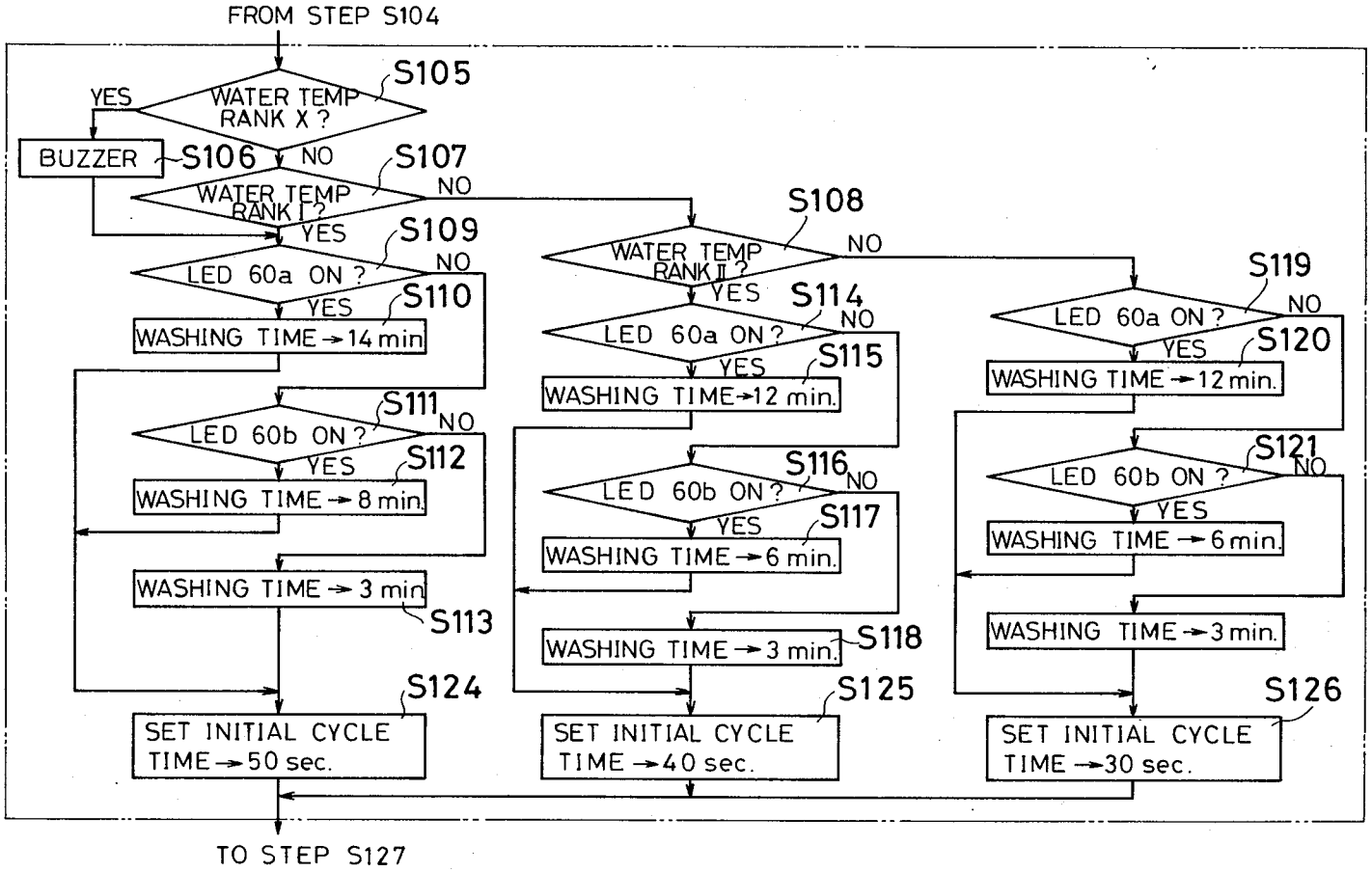
Figure 8C:
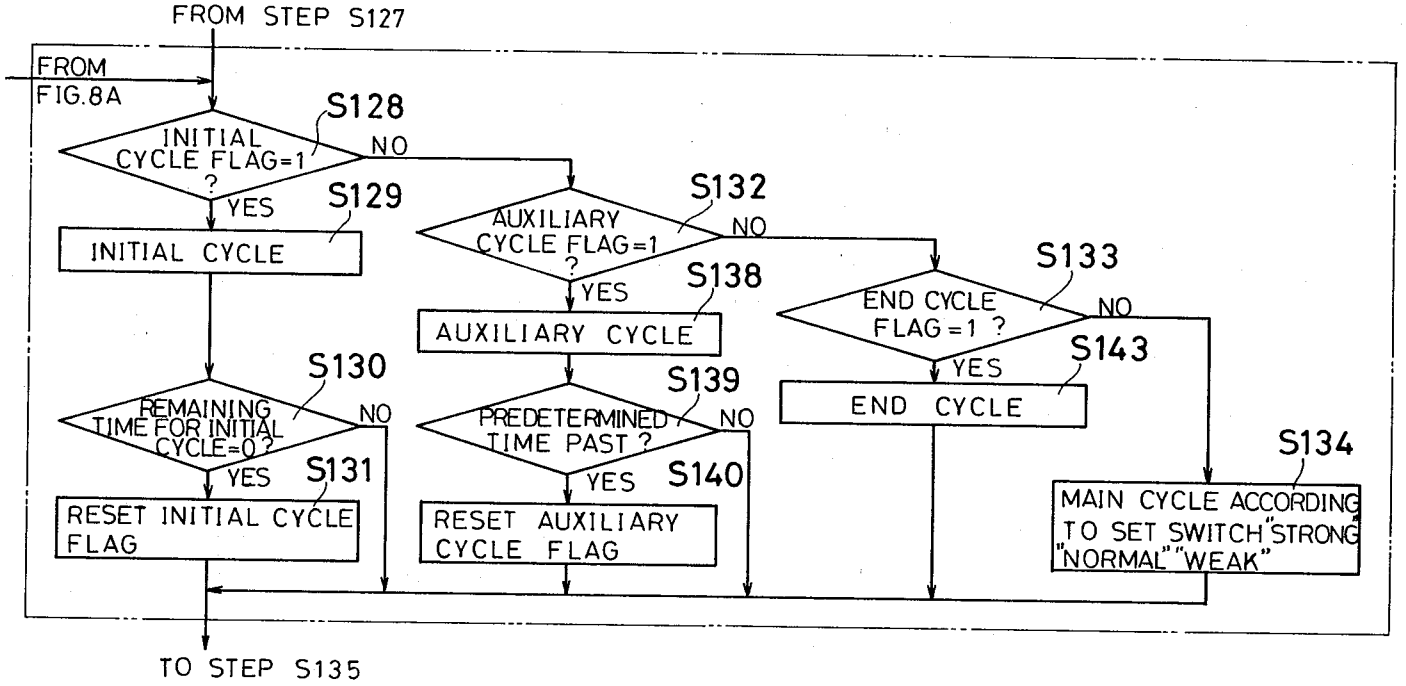

After completing the step S143, again in the step S135, the microcomputer 72 determines whether the washing time has reached zero or not. If the washing time is zero, the process returns from the "washing" subroutine shown in FIGS. 8A and 8B to the main routine shown in preceding FIGS. 7A through 7D.

Returning to FIG. 7B, in the step S17, the microcomputer 72 determines whether "2 times" is set as the number of times of the rinsing process by watching the light emitting diodes 62*a* and 62*b* associated with the switch 62. When 2 times of the rinsing process are set, or "YES" is determined in the step S17, in the following step S18, the microcomputer 72 on the basis of the input from the pressure sensor 44, determines whether more than a predetermined amount of water is filled in the tub 22 or not. When the predetermined amount of water is filled, in the following step S19, the microcomputer 72 sets a "one-minute drainage" flag in the flag area 76 and in the step S20, executes a drainage subroutine shown in FIG. 9.

Figure 9:
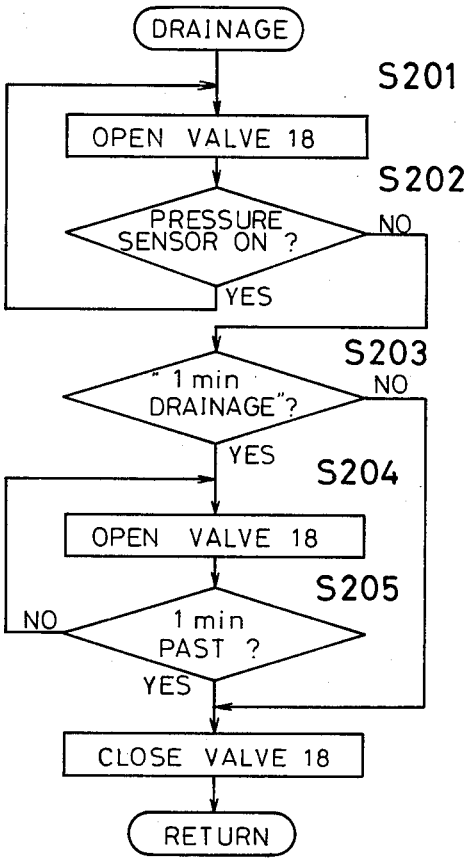
FIG. 9 is a flow diagram showing a subroutine of the "drainage".

Referring to FIG. 9, in the first step S201, the microcomputer 72 opens the drain valve 18 and in the following step S202, determines whether more than a predetermined amount of water is filled in the tub 22 or not on the basis of the input from the pressure sensor 44. That is, by the steps S01 and S202, the drain valve 18 is opened to bring the water level in the tub 22 below the predetermined level.

In the step S203, whether the "one-minute "drainage" flag is set or not is determined, if "one-minute drainage" has been set, the drain valve 18 is opened in the following step S204 and in the step S205, it is determined whether or one minute has elapsed or not. That is, in the steps S204 and S205, the drain valve 18 is opened for one-minute. After one minute has elapsed, as same as when "one-minute drainage" is not set, the drain valve 18 is closed in the step S206 and returns again to the main routine.

When "one minute drainage" is executed in the step S20 in the main routine is such a manner, in the following step S21, the microcomputer 72 determines whether the light emitting diode **56*a* is lit or not, that is, the speedy course is set or not. When the speedy course has been set, in the step S22, "one minute" is set as the dehydration time, when the speedy course has not been set, in the step S23 "two minutes" is set as the dehydration time respectively, then enters the dehydration subroutine in the step S24**.

Figure 10:
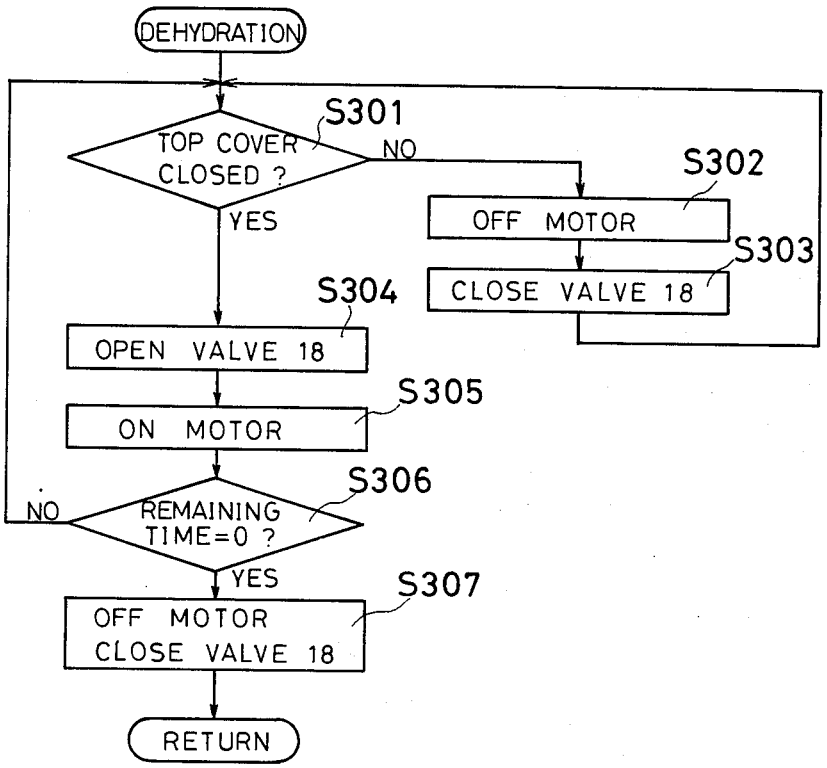
FIG. 10 is a flow diagram showing a subroutine of the "dehydration".

In the dehydration subroutine shown in FIG. 10, in the step S301, the microcomputer 72 first recognizes a cover switch which is not shown, and determines whether the cover is closed or not. If the cover is not closed, in the next step S302, the microcomputer 72 outputs the high level at both output ports P10 and P11 to turn off the motor 32 and to close the drain valve 18 in the step S303. That is, since it is hazardous if the cover is not closed, the dehydration process is not executed.

In the step S301, when it is determined that the cover is closed, in the following step S304, the microcomputer 72 opens the drain valve 18 and in the step S305, outputs the low level at the output port P10 and the high level at the output port P11 respectively to rotate the motor 32 positively, thus the inner tub 22 rotates together with the pulsator 30 and the dehydration process is executed. Such dehydration process is continued for the time set in the preceding step S22 and S23, that is, for one or two minutes. When it is determined in the step S307, that the remaining time for dehydration is over, in the following step S307 the microcomputer 72 turns off the motor 32 and closes the drain valve 18 and returns to the main routine.

When the dehydration process is completed, next the rinsing process will be executed, but in the following step S25, the microcomputer 72 again determines whether the speedy course has been set or not. If the speedy course is set, in the next step S26, the microcomputer 72 sets "one minute" as the rinsing time, but if the speedy course is not set, "two minutes" is set in the step S27 as the rinsing time, then in the following step S28, the rinsing subroutine shown in FIG. 11 is executed.

In the first steps S401 and S402 of the subroutine, the microcomputer 72 determines whether a predetermined amount of water is filled in the inner tub 22 by the pressure sensor 44, if not so opens the water supply valve 50 to supply the water. When more than the predetermined level of water is filled, in the step S403, the microcomputer 72 determines whether the "rinsing with flowing water" is set or not by the switch 68. When the "rinsing with flowing water" has been set the microcomputer 72 leaves the water supply valve 50 open, when not, in the step S405, the microcomputer 72 closes the water supply valve 50. Thereafter, in the step S406, the microcomputer 72 outputs the high level at the output port P10 and the low level at the output port P11 respectively. Thus the motor 32 and the pulsator 30 rotate reversely to form the counter clockwise water current inside the inner tub 22. If the rinsing time set by the steps S26 or S27 is over, after the step S407 and in the step S408, the microcomputer 72 turns off the motor 32 as well as closes the water supply valve 50 if it is open and returns to the main routine.

Returning to FIG. 7C, when "two times" is set as the the number of rinsing times, after completing the step S28, the rinsing of "one time" is again executed in the following steps S29 through S37.

When "one time" is set as the number of rinsing times, the draining→dehydration→rinsing is executed through the steps S29 through S37 in the same manner without passing through the steps S17 through S27. Thus, the rinsing process is completed.

Then, in the step S38 of FIG. 7D, the microcomputer 72 determines whether any of the light emitting diodes **62*a* through 62*c* for the dehydration process is lit or not to determine whether the dehydration process is to be executed. When the dehydration process is to be executed, in the following steps S39 or S40, the microcomputer 72 detects the then air temperature on the basis of data of the temperature sensor 46 fed through its input ports P1 through P4. That is, the temperature sensor 46 detecting the water temperature in the preceding washing process is utilized as the sensor for detecting the air temperature in the dehydration process, whose time is controlled by the microcomputer 72** responsive to the air temperature rank I, II or III.

When the air temperature rank I is detected in the step S39, in the next step S41, the microcomputer 72 determines whether "six minutes" as the dehydration time is set or not. If "six minutes" has been set, since the air temperature is low, in the following step S42, the microcomputer 72 sets "seven minutes" forcibly in the timer 74 as the dehydration time data. In the same manner, in the steps S43 and S44, the microcomputer 72 sets "four minutes" as the dehydration time when the "three minutes" dehydration time has been set. When the dehydration time is set neither at "six minutes" nor at "three minutes", it is deemed that it has been set at "1.5 minutes", so in this case, in the step S45, the microcomputer 72 sets "two minutes" in the timer 74 as the dehydration time. In such a manner, the microcomputer 72 adjusts the dehydration time time data so as to extend the dehydration time being set thereat to set in the timer 74, when the air temperature is low.

When the air temperature rank II is detected in the step S40, in the steps S46 through S50, the microcomputer 72 respectively sets the dehydration time of "six minutes", "three minutes" or "one and half minutes" in the timer 74 as is as the dehydration time data.

If "NO" is determined in the step S40, the then air temperature rank is III or the air temperature is high, thus in the following step S51, the microcomputer 72 determines whether "six minutes" is set as the dehydration time or not. If "six minutes" has been set, since the air temperature is high, in the step S52 the microcomputer 72 sets "5.5 minutes" in the timer 74 as the dehydration time, and if "three minutes" is determined as the dehydration time in the step S53, in the following step S54 the microcomputer 72 adjusts the dehydration time to "2.5 minutes" to set in the timer 74. When "1.5 minutes" is set as the dehydration time, in the step S55 the microcomputer 72 sets "1.5 minutes" in the timer 74 as is as the dehydration time.

In such a manner, the microcomputer 72 forcibly changes the originally set dehydration time responsive to the detected air temperature ranks I, II or III in accordance with the following Table 5 to set in the timer 74. Thereby the constant dehydration condition may be obtained. The reason why the dehydration time is changed is that the higher air temperature the higher rate of natural drying of clothes, that is, the higher rate of dehydration, while the lower air temperature the lower rate of dehydration.

TABLE 5

| Air Temperature Rank | Originally set Dehydration Time (Min.) | | |
|---|---|---|---|
| | 6 | 3 | 1.5 |
| I | 7 | 4 | 2 |
| II | 6 | 3 | 1.5 |
| III | 5.5 | 2.5 | 1.5 |

Thereafter, in the step S56, the microcomputer 72 executes the dehydration process described with reference to preceding FIG. 9 and in the step S57, operates the buzzer 82 to notice the completion of a series of washing processes.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A washing machine comprising;
a tub,
a pulsator arranged rotatably within said tub,
a driving means for rotating said pulsator positively and reversely,
a first means for controlling said driving means to form a first cycle consisting of a set of first repeating units including the positive and reverse rotations of said pulsator, and
a second means for controlling said driving means to form intermittently in said first cycle, a second cycle containing a set of second repeating units including the positive and reverse rotations of said pulsator and shorter than said first cycle.

2. A washing machine in accordance with claim 1, wherein said first means includes means for changing the positively and reversely rotating times for each of said first repeating units.

3. A washing machine in accordance with claim 2, wherein said second means includes means for forming said second repeating unit different from said first repeating unit.

4. A washing machine in accordance with claim 3, wherein said first means includes means for differentiating respective positive and reversely rotating time of the adjoining said first repeating units.

5. A washing machine in accordance with claim 4, wherein said first means includes means for equally or approximately setting the time of said adjoining first repeating unit.

6. A washing machine in accordance with claim 1, wherein the positively and reversely rotating time of said second repeating unit constituting said second cycle are differed from that of said first repeating unit constituting said first cycle.

7. A washing machine in accordance with claim 6, wherein the positively rotating time and reversely rotating time in said second repeating unit constituting said second cycle are equal.

8. A washing machine in accordance with claim 1, which further comprises a temperature detecting means for detecting the temperature of water filled in said washing tub, and a changing means for changing the number of insertion times of said second cycle inserted during said first cycle, responsive to the temperature detected by said temperature detecting means.

9. A washing machine in accordance with claim 8, wherein the lower said temperature the more said changing means increases said number of insertion times of said second cycle.

10. A washing machine in accordance with claim 1, which further comprises a start commanding means for commanding the start of a washing process and a third means for controlling said driving means after the starting command of said start commanding means and prior to said first cycle, to form a third cycle consisting of a set of third repeating units including the positive and reverse rotations of said pulsator.

11. A washing machine in accordance with claim 10, which further comprises a temperature detecting means for detecting the temperature water filled in said tub, and a time changing means for changing the duration of said third cycle responsive to the temperature detected by said temperature detecting means.

12. A washing machine comprising;
an outer tub,
an inner tub provided rotatably within said outer tub to be used both for the washing and dehydration processes,
a pulsator arranged rotatably within said inner tub to be used in said washing process,
a first driving means for rotating said pulsator positively and reversely,
a second driving means for rotating said inner tub in said dehydration process,
a temperature detecting means for detecting the air temperature, and means for controlling the rotating time of said tub driven by said second driving means on the basis of said air temperature detected by said temperature detecting means.

13. A washing machine in accordance with claim 12, further comprising a power switch, wherein said temperature detecting means includes a temperature sensitive element disposed in the position exposed to the air while said tub is not filled with water but submersible when the water is filled, and means for measuring said air temperature based upon the output from said temperature sensitive element soon after said power switch has been turned on, and for measuring thereafter the water temperature in said tub on the basis of the output from said temperature sensitive element.

14. A washing machine in accordance with claim 13, which further comprises an indicating means for selectively indicating said measured air temperature and water temperature.

15. A washing machine in accordance with claim 14, wherein said indicating means includes a plurality of indicator elements, said air temperature or water temperature being indicated in ranks by the respective indicator elements.

16. A washing machine in accordance with claim 13, which further comprises means for controlling said washing process responsive to said water temperature.

17. A washing machine in accordance with claim 16, which further comprises a first means for controlling said driving means to form a first cycle consisting of a set of first repeating units including the positive and reverse rotations of said pulsator and a second means for controlling said driving means to form in said first cycle, a second cycle consisting of a set of second repeating units including the positive and reverse rotations of said pulsator and shorter than said first cycle.

18. A washing machine in accordance with claim 17, which further comprises a changing means for changing the number of insertion times of said second cycle inserted during said first cycle responsive to said water temperature.

19. A washing machine in accordance with claim 12, which further comprises means for controlling said driving means to form a cycle consisting of a set of repeating units including the positive and negative rotations of said pulsator.

20. A washing machine comprising:

a tub, a pulsator rotatably arranged within said tub, a driving means for positively and reversely rotating said pulsator, and means for controlling said driving means to form a cycle consisting of a set of repeating units including the positive and reverse rotations of said pulsator said means for controlling including means for making the durations of said positive and reverse rotations different in each repeating unit.

* * * * *